US008931552B2

(12) United States Patent
Head

(10) Patent No.: US 8,931,552 B2
(45) Date of Patent: Jan. 13, 2015

(54) CABLES FOR DOWNHOLE USE

(75) Inventor: Philip Head, Egham Surrey (GB)

(73) Assignee: AccessESP UK Limited, Staines, Surrey (GB)

( * ) Notice: Subject to any disclaimer, the term of this patent is extended or adjusted under 35 U.S.C. 154(b) by 677 days.

(21) Appl. No.: 13/140,937

(22) PCT Filed: Nov. 13, 2009

(86) PCT No.: PCT/GB2009/051535
§ 371 (c)(1),
(2), (4) Date: Jul. 13, 2011

(87) PCT Pub. No.: WO2010/070305
PCT Pub. Date: Jun. 24, 2010

(65) Prior Publication Data

US 2011/0259580 A1 Oct. 27, 2011

(30) Foreign Application Priority Data

Dec. 19, 2008 (GB) ..... 0823225.8

(51) Int. Cl.
*E21B 41/00* (2006.01)
*E21B 17/20* (2006.01)
*H01B 7/04* (2006.01)

(52) U.S. Cl.
CPC ..... *E21B 17/206* (2013.01); *H01B 7/046* (2013.01)
USPC ..... 166/242.2; 166/77.2; 166/385; 166/65.1

(58) Field of Classification Search
USPC ..... 166/77.2, 75.11, 385, 75.14, 242.2
See application file for complete search history.

(56) References Cited

U.S. PATENT DOCUMENTS

| | | | | |
|---|---|---|---|---|
| 5,485,745 | A | 1/1996 | Rademaker et al. | |
| 5,906,242 | A * | 5/1999 | Bruewer et al. | 166/378 |
| 5,996,689 | A | 12/1999 | Head | |
| 7,934,548 | B2 * | 5/2011 | Doud et al. | 166/250.01 |
| 2008/0142244 | A1 | 6/2008 | Head | |

OTHER PUBLICATIONS

International Search Report for Appl. No. PCT/GB2009/051535 dated May 10, 2010.

* cited by examiner

*Primary Examiner* — Robert E Fuller
(74) *Attorney, Agent, or Firm* — Greenberg Traurig, LLP

(57) ABSTRACT

A cable and tubing suspends an electrically powered tool in a borehole and provides the tool with electrical power. The cable is disposed in the tubing, and the cable incorporates a conducting member which carries the majority of the tensile stress on the cable without the cable being secured along its length to the inside of the tubing. The cable may be capable of supplying high voltage electrical power, in which case the cable comprises a conducting member having a steel core, an outer cladding of copper, and at least one insulating layer surrounding the outer cladding of copper. The copper makes up between 20% and 40% of the total metal content of the cable, the cable being able to support at least its own weight.

15 Claims, 4 Drawing Sheets

CABLES FOR DOWNHOLE USE

This invention relates to cables for downhole use, particularly the disposition of cables for powering tools.

Coiled tubing is often used to suspend downhole tools in a well bore. The coiled tubing is stiff enough to apply a generally downward force to the tool if necessary, to push the tool vertically or horizontally along the well, and has sufficient strength to pull the tool from the well. Coiled tubing also allows the tools to be conveniently deployed in the well without having to kill the well, and provides a protected environment for power cables with which to power the tool.

To support the electrical cable in the coiled tubing, coiled tubing may be supplied with anchor devices to frictionally support the cable at intervals. Further methods include providing dimples on the inner surface of the coiled tubing to support the electric cable, and filling the coiled tubing with a dense liquid so that the electric cable supported by some degree of buoyancy.

Further, many wells have high temperatures, for example a Steam-assisted gravity driven (SAGD) well may approach 250° C. Any solution should be able to withstand such high temperatures for extended periods.

The object of the present invention is provide an alternative method of deploying cable in coiled tubing that is more convenient and economic to install.

According to the present invention, there is provided cable and coiled tubing for suspending an electrically powered tool in a borehole and providing the tool with electrical power by the cable, the cable being disposed in the coiled tubing, the cable incorporating a conducting member which carries the majority of the tensile stress on the cable, and without the cable being secured along its length to the inside of the coiled tubing.

According to another aspect of the present invention, there is provided cable for use in a borehole or the like for supplying high voltage electrical power, wherein the cable comprising: a conducting member having a steel core, an outer cladding of copper, and at least one insulating layer surrounding the outer cladding of copper, the copper making up between 20% and 40% of the total copper and steel content of the cable, the cable being able to support at least its own weight.

The coiled tubing and power cable have very similar coefficients of thermal expansion, so when exposed to high temperatures limited differential stress is applied to the electrical insulation.

According to a further aspect of the present invention there is provided a cable termination member adapted for a cable as herein defined, including a gripping element for attaching to the steel core of the cable, and a conductive element for conductively abutting to the outer cladding of copper.

The invention will now be described, by way of example, with reference to the following drawings, of which FIG. 1 shows a cross sectional view of the cable and coiled tubing; and FIG. 2 shows a longitudinal sectional view of the cable and coiled tubing disposed in a SAGD well.

Figure 1:
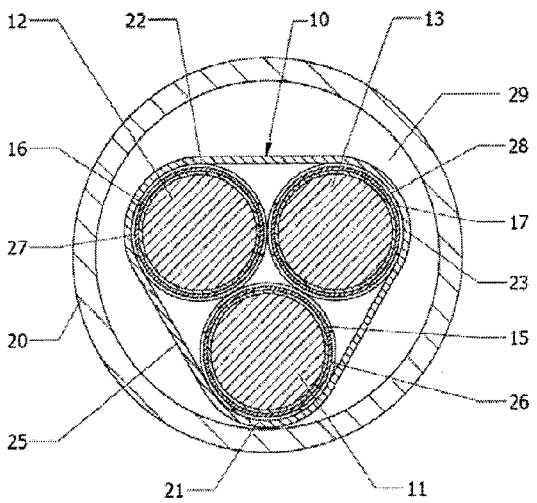

Referring to FIG. 1, there is shown a cable 10 disposed in coiled tubing 20. The cable includes three steel conductors 11, 12, 13 having layers of copper cladding 15, 16, 17. Each of the copper clad conductors are then coated in a polyamide layer 26, 27, 28 which electrically insulates the conductors. In turn, the polyamide layer is coated with a layer of glass fibre and resin 21, 22, 23. The glass fibre and resin layer also has dielectric properties and provides further insulation for the conductors, but also afford mechanical protection. Finally, the conductors 11, 12, 13 and the applied layers are bound in a triangular configuration by a external tape layer 25. This external tape layer 25 provides some protection to the conductors when the cable is being handled, and when it is dragged into the coiled tubing. The external tape layer 25 may include lubrication to make the cable's insertion into the coiled tubing easier, and may provide additional dielectric properties to insulate the conductors. The void 29 in the coiled tubing not occupied by the cable may be filled with dielectric oil.

Steel conductors are less conductive than copper, but have a much higher tensile strength. The recommended cable size for 104 Amps in pure copper is AWG #3 gauge or 5.827 mm OD. To achieve the same heat flux with Copper Clad wire of 40% conductivity, an AWG #0 or 8.252 mm OD is required. To accommodate the deployment of the cable, a standard coil tubing size was selected. A 1.75 foot (0.53 m) OD coiled tube with a 0.109 foot (0.03 m) thickness was selected.

Such a cable made of steel conductors is sufficiently strong to support itself over a borehole depth of many 1,000s of feet. The cable therefore does not need to be anchored or secured to the inner surface of the coiled tubing. In addition, since coiled tubing is typically manufactured from steel, the conductors of the cable and the coiled tubing will expand at the same rate as the temperature of the well increases. The insulating material described all performs well under increased temperature.

Figure 2:
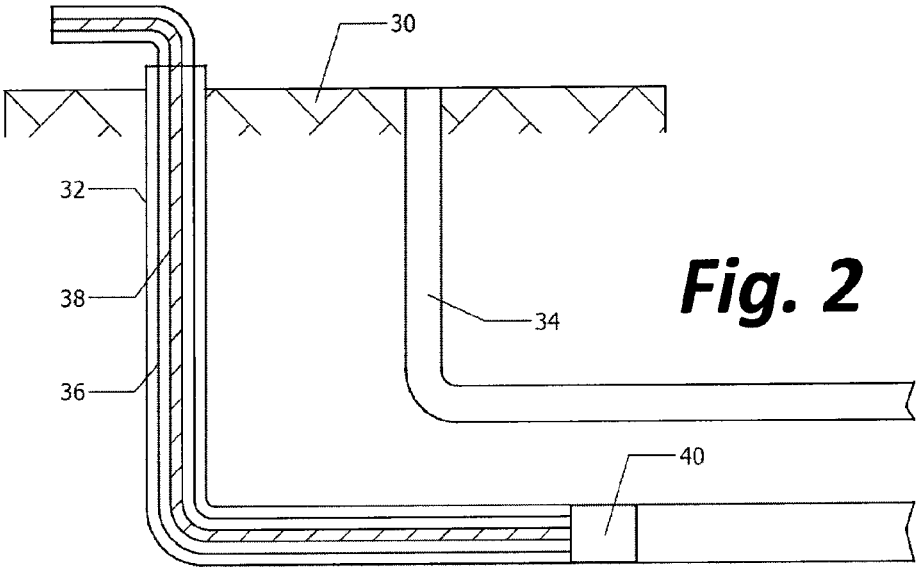

Referring to FIG. 2, a SAGD well typically has an upper borehole 34 and a lower borehole 32 in ground 30, both boreholes having substantially vertical parts and substantially horizontal parts, the horizontal part of the upper borehole 34 being substantially above the horizontal part of the lower borehole 32. An electrically powered pump 40 is suspended on coiled tubing 36 and the cable 38 described above, first being lowered into the vertical part of the lower borehole 32 and then being pushed into the horizontal part of the lower borehole 32. The cable 38 not only supports itself, but may support the pump and also be used to apply force to the pump to help its installation in the horizontal part of the borehole 34. Steam from the upper borehole stimulates oil production into the lower borehole 34, which is then assisted to the surface by the pump 40.

Figure 3:
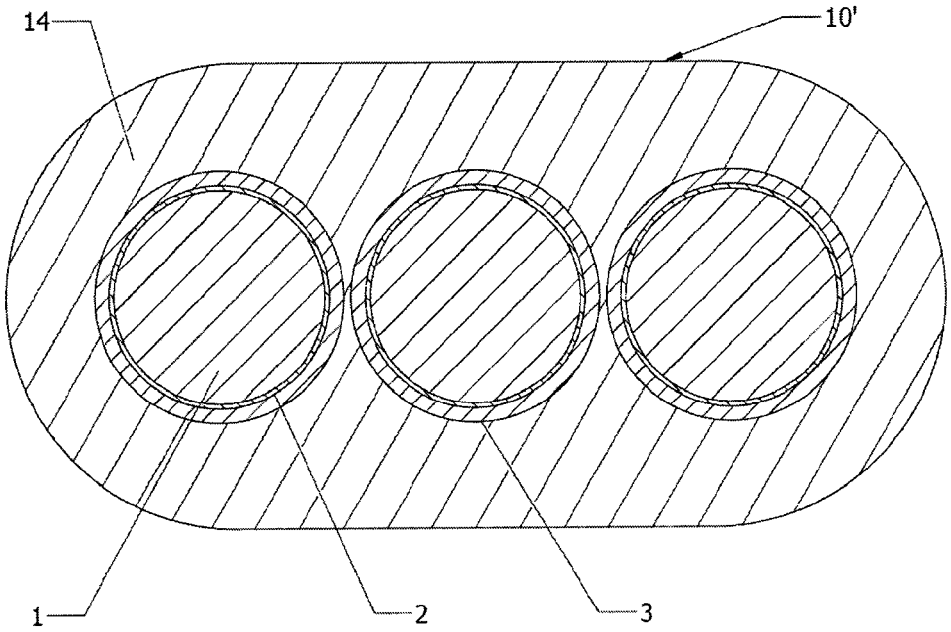
FIG. 3 shows a cross sectional view of an another embodiment of cable.

Referring to FIG. 3, cable 10' has three steel cores 1, each having a copper cladding 2 extruded onto them. Over each layer of copper cladding, a polyamide insulation layer 3 is extruded. The three cores are then positioned side-by-side in a flat arrangement and a layer of thermoplastic 14 is extruded over all three cores.

The steel core provides the cable with sufficient strength to support the cables own weight at the type of lengths necessary (600 meters and more) to provide power to tools in a downhole environment. The steel core also conducts electricity, but is not as conductive as the copper cladding, which carries most of the current. It has been found that when the copper cladding makes up over 20% of the total metal content by weight of the cable, the cable is able to carry a high voltage over the necessary lengths. However, when the weight of the copper cladding makes up over 40% of the total metal content by weight of the cable, although the conductivity of the cable is improved, the cable is not sufficiently strong to support its own weight. Therefore, the optimum copper content of the total metal content by weight of the cable is between 20% and 40%. Particularly at the lower percentages of copper, the cable may be sufficiently strong to also support a load, such as a motor and/or pump suspended from the cable.

Figure 4:
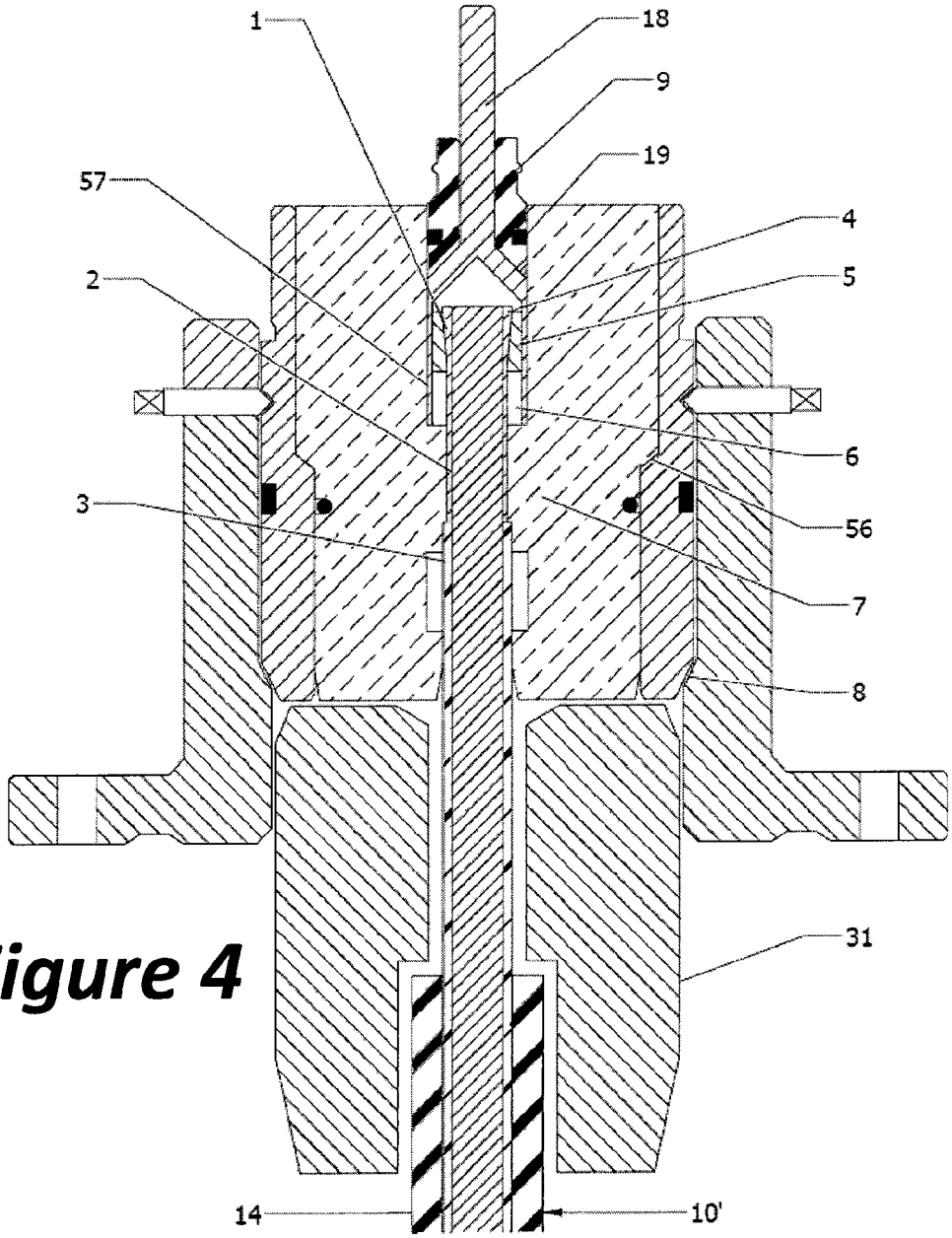
FIGS. 4 and 5 show sectional views of the cable shown in FIG. 3 engaging with a termination member.

Referring now to FIG. 4, at the extreme upper end of the cable 10', the copper cladding 2 has been removed from a steel core 1 and a set of tapered gripping segments 4 are disposed about steel core 1, and the set of tapered gripping segments 4 fit in a bowl 5 having a conical inner surface. The friction between the gripping segments 4 and the steel core 1 causes the gripping elements to grip the hanging cable and take its weight, and in turn transfer the load to the bowl 5. A copper spacer 6 fits tightly to the copper cladding 2 below the bowl 5. The hanging load is transmitted through the bowl 5 to the ceramic holder 7 which rests on a shoulder 56 of a surface termination 8, and also in turn transmits the hanging load to the surface termination 8.

An upwardly-pointing male pin 18 has a copper spacer skirt 57, which slides over both the gripping segments 4 and bowl 5, and the copper spacer 6, to fit tightly against the copper spacer 6. The upper end of the male pin 18 has an insulation member 9 with seal 19 fitted over it.

Figure 5:
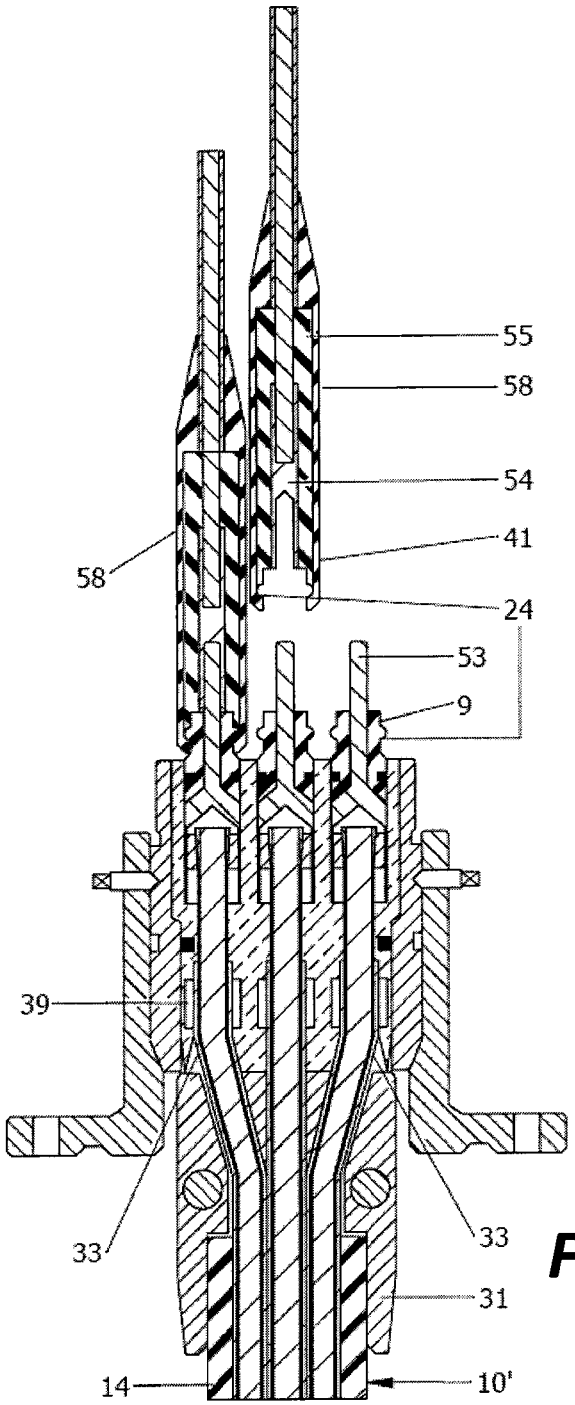

Referring to FIG. 5, the steel cores 1 of cable 10' are separated from their thermoplastic insulation 14 (as a preliminary step to stripping the copper cladding 2 from the steel cores 1) to pass through individual sealing arrangements 33. A split stress relief joint 31 supports and separates the two external steel cores 1 of cable 10' back to their close proximity to the center steel core 1 of cable 10'.

A seal 39 around each of the cable 10' has a series of ridges facing the direction of pressure, to distribute the compression force on the cable insulation layer 3.

At the upper termination, individual female connectors 58 plug onto the male pins 18. The female connectors 58 consist of a copper attachment 54 which
terminates the cable and allows a tight electrical contact to the male pin 18. An insulation bushing 55 fits over the connector 54 and a rubber boot 41 fits tightly over the bushing 55. When fitted over the male pin 18, matching profiles 24 on the inner surface of the boot 41 and the insulated member 9 seals the boot 41 and the insulated member 9.

The invention claimed is:

1. A downhole assembly in a borehole, comprising:
- tubing extending down the borehole;
- a self-supporting cable disposed inside the tubing;
- and an electrically powered tool suspended in the borehole at a lower end of the tubing and the cable;
- the cable comprising at least one conductor for supplying power to the tool,
- the at least one conductor comprising a conductive portion surrounded by an insulating layer;
- wherein the conductive portion comprises a steel core and an outer cladding of copper which support the weight of the at least one conductor in tension; and
- wherein a cable termination member is arranged at an upper end of the cable to support the cable and transfer its hanging weight to a surface termination, the cable termination member including a gripping element that grips the steel core, and a conductive element that conductively abuts the respective outer cladding of copper.

2. The downhole assembly according to claim 1, wherein the cable comprises three conductors for supplying power to the tool, each conductor comprising a conductive portion surrounded by an insulating layer, each conductive portion comprising a steel core and an outer cladding of copper which support the weight of the conductor in tension.

3. The downhole assembly according to claim 1, wherein the outer cladding of copper of the at least one conductor comprises from 20% to 40% of the total metal content by weight of the cable.

4. The downhole assembly according to claim 1, wherein the outer cladding of copper is a layer extruded onto the core of the at least one conductor.

5. The downhole assembly according to claim 1, wherein the cable is at least 600 m in length.

6. The downhole assembly according to claim 1, wherein the tool is an electrically powered pump for pumping fluid produced by the well to a ground surface.

7. The downhole assembly according to claim 1, wherein the cable termination member includes a ceramic element, and the weight of the cable is transferred from the gripping element to the surface termination via the ceramic element.

8. The downhole assembly according to claim 1, wherein the conductive element is arranged below the gripping element.

9. The downhole assembly according to claim 1, wherein the gripping element comprises a set of tapered gripping segments arranged in a bowl having a conical inner surface.

10. An apparatus for supplying power to a tool deployed in a borehole, comprising:
- a self-supporting cable extending from a surface termination down the borehole,
- the cable comprising at least one conductor for supplying power to the tool,
- the at least one conductor comprising a conductive portion surrounded by an insulating layer,
- the conductive portion comprising a steel core and an outer cladding of copper which support the weight of the conductor in tension;
- and a cable termination member arranged at an upper end of the cable to support the cable and transfer its hanging weight to the surface termination;
- wherein the cable termination member includes a gripping element that grips the steel core,
- and a conductive element that conductively abuts the outer cladding of copper.

11. The apparatus according to claim 10, wherein the cable termination member includes a ceramic element, and the weight of the cable is transferred from the gripping element to the surface termination via the ceramic element.

12. The apparatus according to claim 10, wherein the conductive element is arranged below the gripping element.

13. The apparatus according to claim 10, wherein the gripping element comprises a set of tapered gripping segments arranged in a bowl having a conical inner surface.

14. The apparatus according to claim 10, wherein the cable comprises three conductors for supplying power to the tool, each conductor comprising a conductive portion surrounded by an insulating layer, each conductive portion comprising a steel core and an outer cladding of copper which support the weight of the conductor in tension, and each conductor is supported by a respective said gripping element and conductive element.

15. The apparatus according to claim 10, wherein the outer cladding of copper of the at least one conductor comprises from 20% to 40% of the total metal content by weight of the cable.

* * * * *